US012528617B2

(12) United States Patent
Feiner

(10) Patent No.: US 12,528,617 B2
(45) Date of Patent: Jan. 20, 2026

(54) NESTABLE PALLET WITH IMPROVED RACKING AND CONVEYOR PERFORMANCE

(71) Applicant: Digipal Solutions Israel Ltd., Ramat Hasharon (IL)

(72) Inventor: Gideon Feiner, Ramat Hasharon (IL)

(73) Assignee: Digipal Solutions Israel Ltd., Ramat Hasharon (IL)

( * ) Notice: Subject to any disclaimer, the term of this patent is extended or adjusted under 35 U.S.C. 154(b) by 95 days.

(21) Appl. No.: 18/401,505

(22) Filed: Dec. 31, 2023

(65) Prior Publication Data

US 2024/0425235 A1 Dec. 26, 2024

Related U.S. Application Data

(60) Provisional application No. 63/511,875, filed on Jul. 4, 2023, provisional application No. 63/521,920, filed on Jun. 20, 2023.

(51) Int. Cl.
*B65D 19/38* (2006.01)
*B65D 19/00* (2006.01)

(52) U.S. Cl.
CPC ..... *B65D 19/385* (2013.01); *B65D 19/004* (2013.01); *B65D 2519/00308* (2013.01); *B65D 2519/00338* (2013.01); *B65D 2519/0094* (2013.01)

(58) Field of Classification Search
CPC .... B65D 2519/0094; B65D 2519/0096; B65D 19/38; B65D 19/385
See application file for complete search history.

(56) References Cited

U.S. PATENT DOCUMENTS 3,630,157 A * 12/1971 Ortenblad ..... B65D 19/0018 108/901
5,341,748 A * 8/1994 Liu ..... B65D 19/40 108/53.3
11,174,070 B2 * 11/2021 Kalinowski ..... B65D 19/0018
11,820,551 B2 11/2023 Feiner
(Continued)

FOREIGN PATENT DOCUMENTS

EP 0915022 A1 5/1999
EP 3670375 A1 6/2020
(Continued)

OTHER PUBLICATIONS

International Search Report for PCT/EP2023/056169 Mailed On Sep. 27, 2023.

*Primary Examiner* — Daniel J Rohrhoff
(74) *Attorney, Agent, or Firm* — The Roy Gross Law Firm, LLC; Roy D. Gross

(57) ABSTRACT

A nestable pallet (100, 200, 300, 400) has a deck (102) for supporting a load and a set of hollow tapered legs (106), the legs having an upper opening and an inwardly-tapered internal surface (108) for receiving part of a corresponding leg of another pallet when a plurality of similar pallets are stacked. Some of the hollow legs have a peripheral support configuration that includes a lower-leg extension (110), projecting horizontally from an inwardly-tapered portion of the leg towards an edge (112) of the pallet and an upper-leg opening (114) for receiving the lower-leg extension of another pallet when a plurality of similar pallets are stacked.

6 Claims, 18 Drawing Sheets

(56) References Cited

U.S. PATENT DOCUMENTS

| | | | | |
|---|---|---|---|---|
| 2004/0134390 | A1* | 7/2004 | Apps | B65D 19/38 108/53.1 |
| 2013/0032507 | A1* | 2/2013 | Du Toit | B65D 19/0012 206/599 |
| 2022/0289427 | A1* | 9/2022 | Coubray | B65D 19/0018 |
| 2023/0174271 | A1* | 6/2023 | Feiner | B65D 19/38 108/53.3 |
| 2025/0100747 | A1* | 3/2025 | Hassell | B65D 19/40 |

FOREIGN PATENT DOCUMENTS

| | | | |
|---|---|---|---|
| JP | 2000326975 | A | 11/2000 |
| JP | 2006077605 | A | 3/2006 |
| JP | 2016034840 | A | 3/2016 |
| WO | 2016034513 | A1 | 3/2016 |

* cited by examiner 200
102
VII
108
114

122
122
122
104
VIII
106

102
108
104
114
110
106
110
114

NESTABLE PALLET WITH IMPROVED RACKING AND CONVEYOR PERFORMANCE

FIELD AND BACKGROUND OF THE INVENTION

The present invention relates to pallets and, in particular, it concerns a nestable pallet with improved racking, stacking and conveyor performance.

Traditional pallets, typically made of wood, have a load-bearing deck 1000 and runners 1002 contacting the ground, such as is illustrated in FIG. 1. The runners extend to the ends of the pallet.

Pallets 1004 (FIG. 2A) made primarily from polymer materials are known to provide numerous advantages, being robust and reusable. For compact return shipping, they are sometimes implemented with hollow tapered leg structures 1006 in order to be compactly nestable with other similar pallets. The inward taper required to allow nesting together with the positioning of the legs inside a peripheral wall of the deck causes the lower part of the leg to be set-in significantly from the edge of the pallet deck, denoted d in FIG. 2A.

Nestable pallets are used increasingly, since they take up much less volume when empty and piled together. Normally a pile of nested pallets can contain roughly three times more pallets at same volume compared to conventional (with bottom deck) pallets with the same outer dimensions. Nestable pallets however have a number of limitations or disadvantages as a result of their geometry. In order to allow nestability, the nestable pallet legs require a draft angle to allow them to nest one into another and to be easily separated one from another when nested together. This means that the pallet leg at the bottom (where it touches the floor or a supporting surface) cannot reach the outer dimension of the pallet top deck and is inclined inwards. Typically, with a pallet of 120 cm length, this means the leg at the bottom is set-in from the perimeter of the pallet by "d" of at least 4 cm at each end, and typically more.

This position of the legs set-in from the edge of the pallet limits functionality of the pallet in various ways. Firstly, this results in less margin of safety when being racked between two beams in storage, as illustrated schematically in FIG. 2B. The outer distance between legs of a conventional (e.g., wooden) pallet is the full length of a pallet which, in the case of a 120 cm*100 cm pallet, is 120 cm. The outer dimensions of the legs at the bottom of a nestable pallet is typically 120 cm−8 cm=112 cm or less. The outer dimension between beams of a racking system is fixed, and is normally around 110 cm. This means when placing a conventional pallet on these racks it has more safety margin compared to nestable pallet. FIG. 2B shows a nestable pallet placed in the "correct" (solid lines) and "incorrect" (dashed lines) positions on beams of a rack.

A further limitation of conventional nestable pallets, illustrated in FIG. 2C, relates to an inability to "double stack" a nestable pallet on top of open crates. As seen in this sketch, the outer legs of the pallet do not reach the walls of the underlying crates, resulting in the upper pallet being unstable and/or weighing down on the contents of the crates.

A further issue relates to use on a conveyor. Nestable pallets may be at increased risk of swiveling when being transported on conveyors (roll or chain), as alignment of pallets on the conveyor is achieved by guides at the sides of the conveyor, at the height of the legs. With nestable pallets, the width of the legs at bottom or any place beneath the top deck is less than the full width of the pallet at its top deck. This allows twisting of the pallet, as illustrated in FIG. 2D, which might lead to catching on objects etc.

SUMMARY OF THE INVENTION

The present invention is a nestable pallet with improved racking and conveyor performance.

According to the teachings of an embodiment of the present invention there is provided, a nestable pallet for supporting a load above a floor comprising: (a) a deck having an upper surface for supporting the load, the deck having an outer perimeter; and (b) a set of hollow legs rigidly integrated with the deck and extending downwards from the deck so as to support the deck above the floor, each of the hollow legs having an upper opening and an inwardly-tapered internal surface for receiving part of a corresponding leg of another pallet when a plurality of similar pallets are stacked, wherein a plurality of the hollow legs adjacent to the outer perimeter each includes a peripheral support configuration comprising: (i) a lower-leg extension projecting horizontally from an inwardly-tapered portion of the leg towards an edge of the pallet corresponding to a downwards projection of the outer perimeter, and (ii) an upper-leg opening for receiving the lower-leg extension of another pallet when a plurality of similar pallets are stacked.

According to a further feature of an embodiment of the present invention, the lower-leg extension forms part of a closed shape of a lower part of the leg.

According to a further feature of an embodiment of the present invention, the inwardly-tapered portion of the leg has a taper angle of at least 3 degrees, and wherein the lower-leg extension has a draft angle of no more than 2 degrees.

According to a further feature of an embodiment of the present invention, the outer perimeter of the deck is continuous around the deck, and wherein the lower-leg extension is sized so as to fit within the outer perimeter when a plurality of similar pallets are stacked.

According to a further feature of an embodiment of the present invention, the inwardly-tapered internal surface of each of the hollow legs defines a generally rectangular horizontal cross-sectional shape, and wherein at least one edge of the rectangular horizontal cross-sectional shape is interrupted by the upper-leg opening and the lower-leg extension, the lower-leg extension extending outside the rectangular horizontal cross-sectional shape.

According to a further feature of an embodiment of the present invention, at least one of the hollow legs adjacent to a corner of the deck is formed with two of the peripheral support configurations extending towards two adjacent edges of the pallet.

According to a further feature of an embodiment of the present invention, the hollow legs are integrally formed with the deck.

According to a further feature of an embodiment of the present invention, the hollow legs are mechanically attached to the deck.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1:
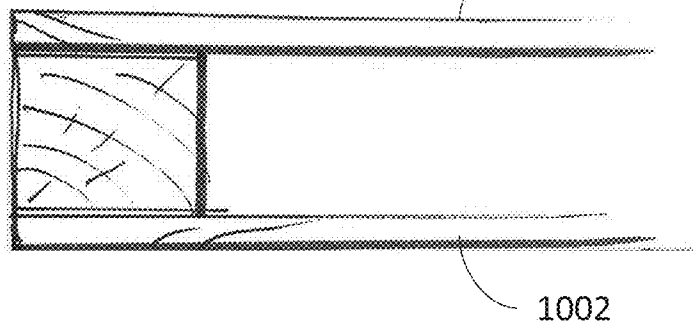
FIG. 1 (PRIOR ART)
FIG. 1, described above, is a schematic partial side view of a conventional non-nestable pallet.

The present invention is a nestable pallet with improved racking and conveyor performance.

The principles and operation of pallets according to the present invention may be better understood with reference to the drawings and the accompanying description.

Referring now to the drawings, FIGS. 3A-10 illustrate various implementations of a nestable pallet, generally designated 100, 200, 300, 400, constructed and operative according to the teachings of embodiments of the present invention, for supporting a load above a floor. In general terms, the nestable pallet has a deck 102 providing an upper surface for supporting the load and an outer perimeter 104. A set of hollow legs 106 are rigidly integrated with deck 102 and extend downwards from the deck so as to support the deck above the floor. Each hollow leg 106 has an upper opening and an inwardly-tapered internal surface 108 for receiving part of a corresponding leg of another pallet when a plurality of similar pallets are stacked.

A plurality of the hollow legs, which may be some or all of the legs that are adjacent to outer perimeter 104, each has a peripheral support configuration that includes a lower-leg extension 110, projecting horizontally from an inwardly-tapered portion of the leg towards an edge 112 of the pallet defined by a downwards-projection of the outer perimeter 104 (see FIG. 4A), and an upper-leg opening 114 for receiving the lower-leg extension of another pallet when a plurality of similar pallets are stacked.

Figure 2A:
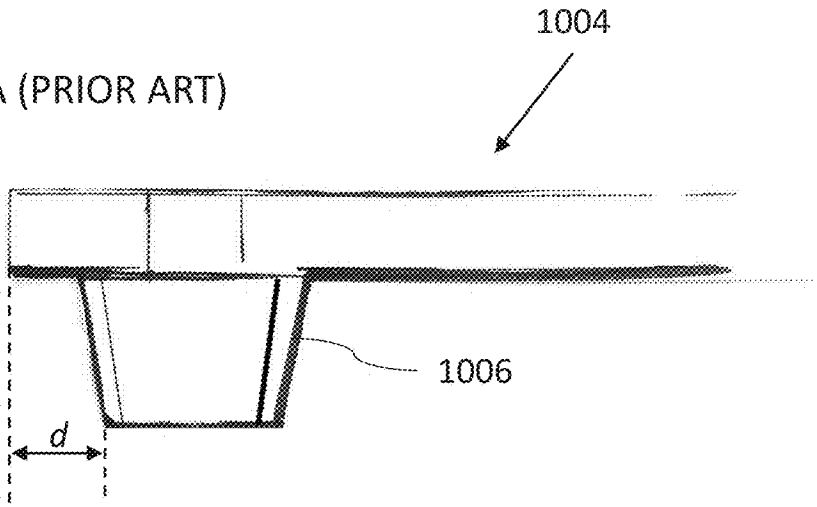
FIG. 2A (PRIOR ART)
FIG. 2A, described above, is a schematic partial side view of a conventional nestable pallet.
Figure 2D:
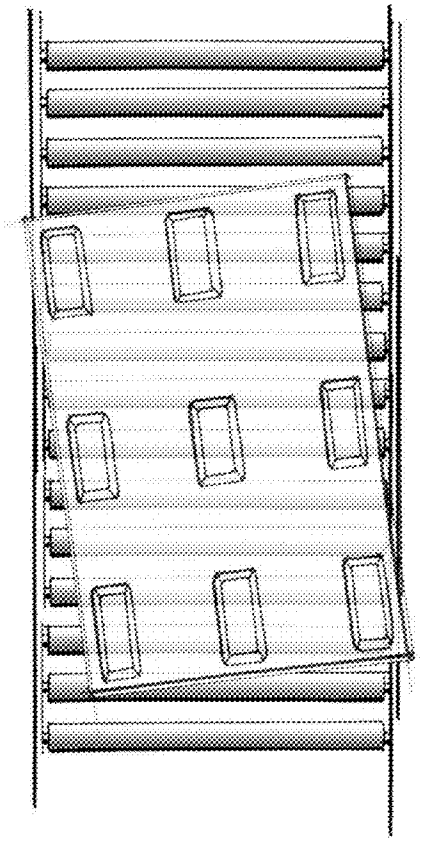
FIGS. 2B-2D, described above, are schematic illustrations of functional limitations of the pallet of FIG. 2A in the context of racking, stacking and conveyance, respectively.
Figure 2B:
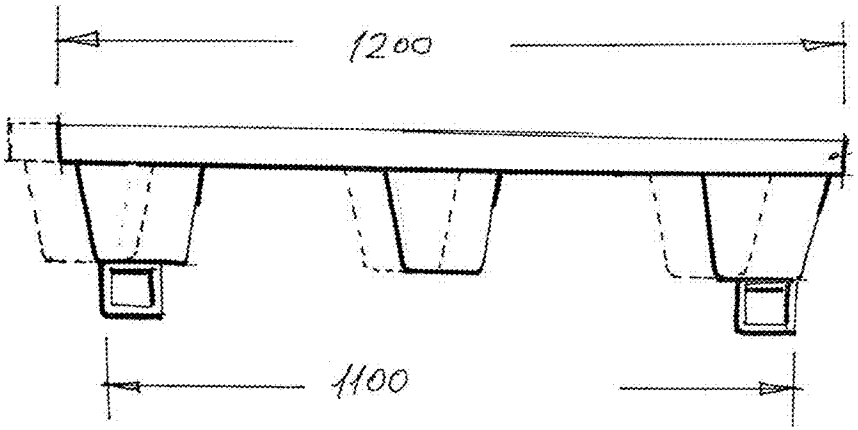
Figure 2C:
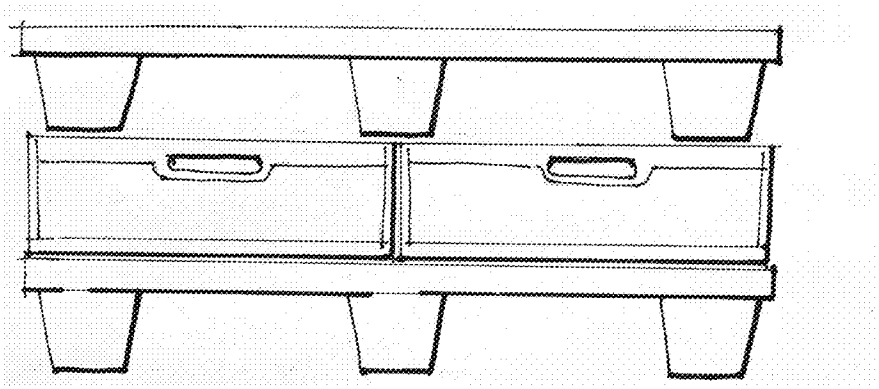
Figure 3A:
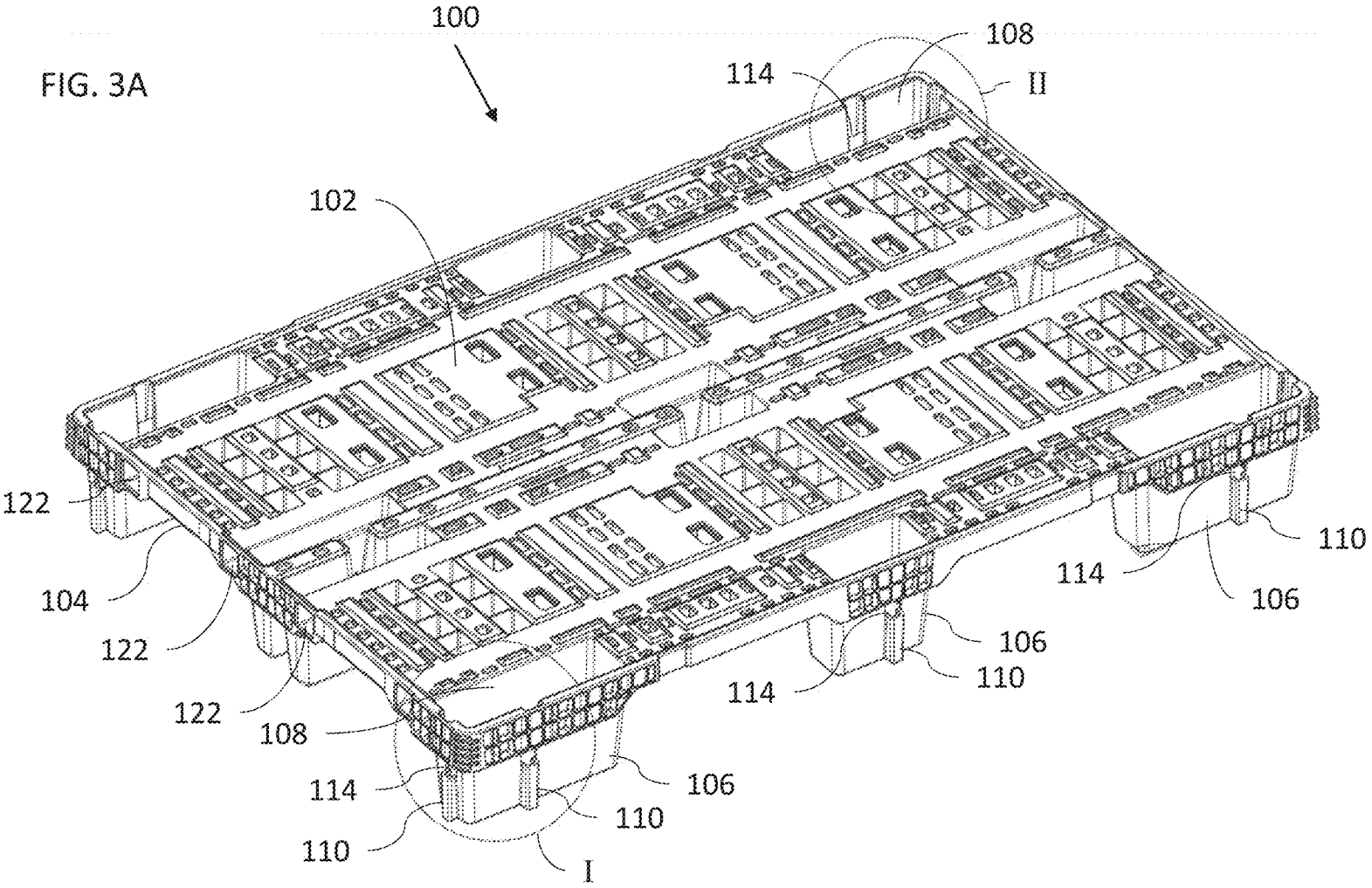
FIG. 3A is an isometric view of a pallet, constructed and operative according to the teachings of an embodiment of the present invention.
Figure 3C:
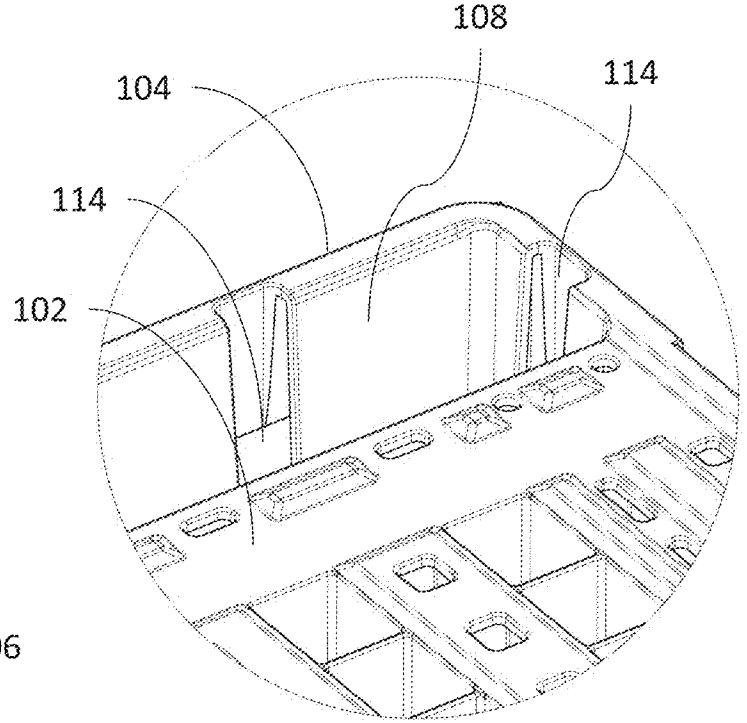
FIGS. 3B and 3C are enlarged views of the regions of FIG. 3A designated I and II, respectively.
Figure 3B:
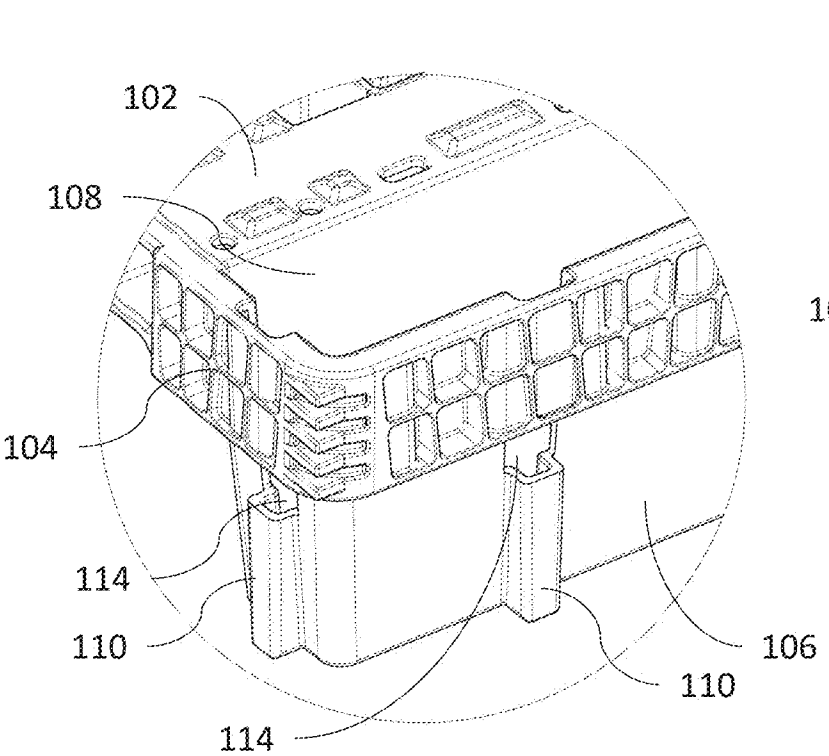
Figure 3D:
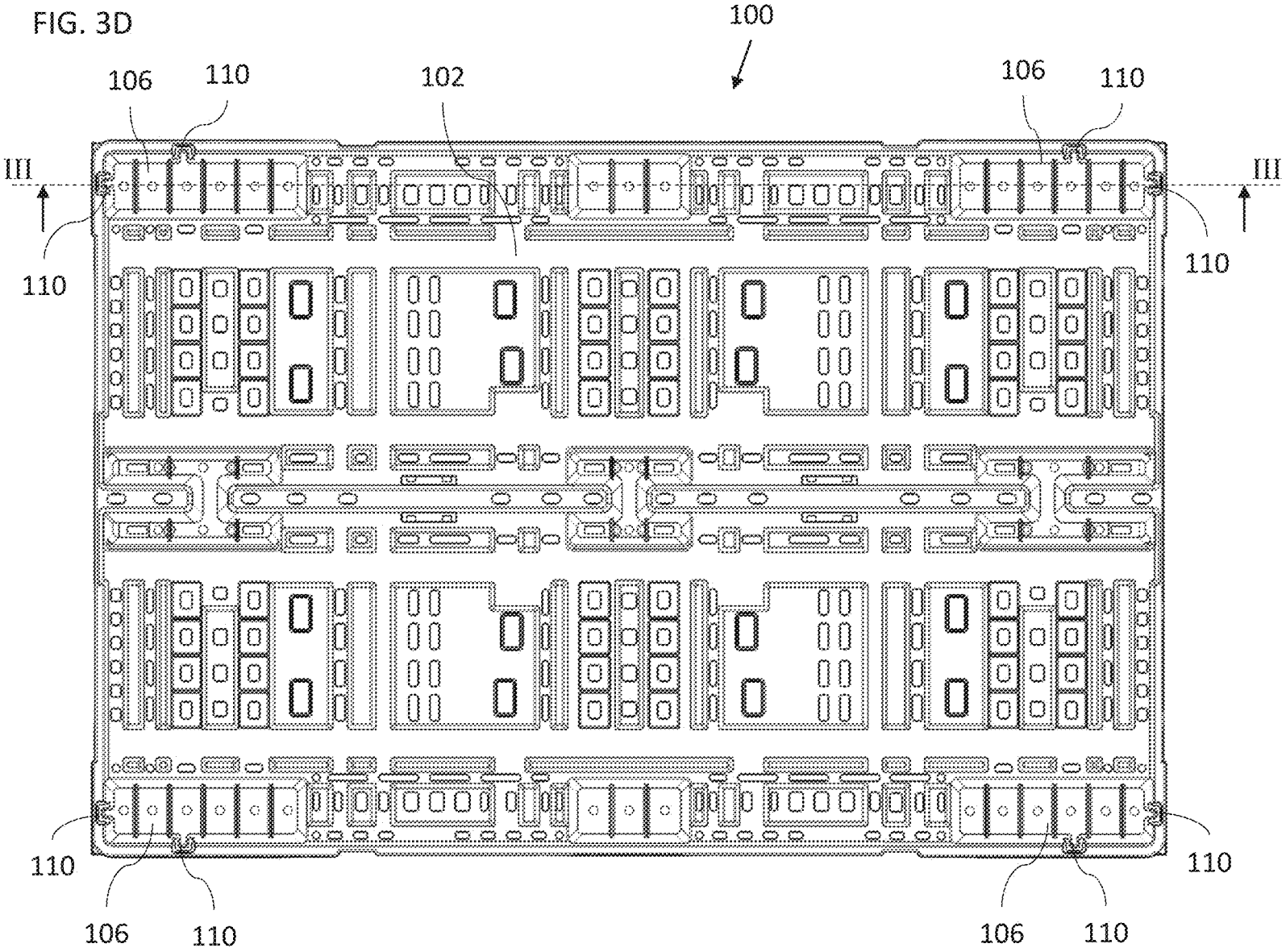
FIG. 3D is a plan view of the pallet of FIG. 3A.
Figures 3E, 3F, 3G:
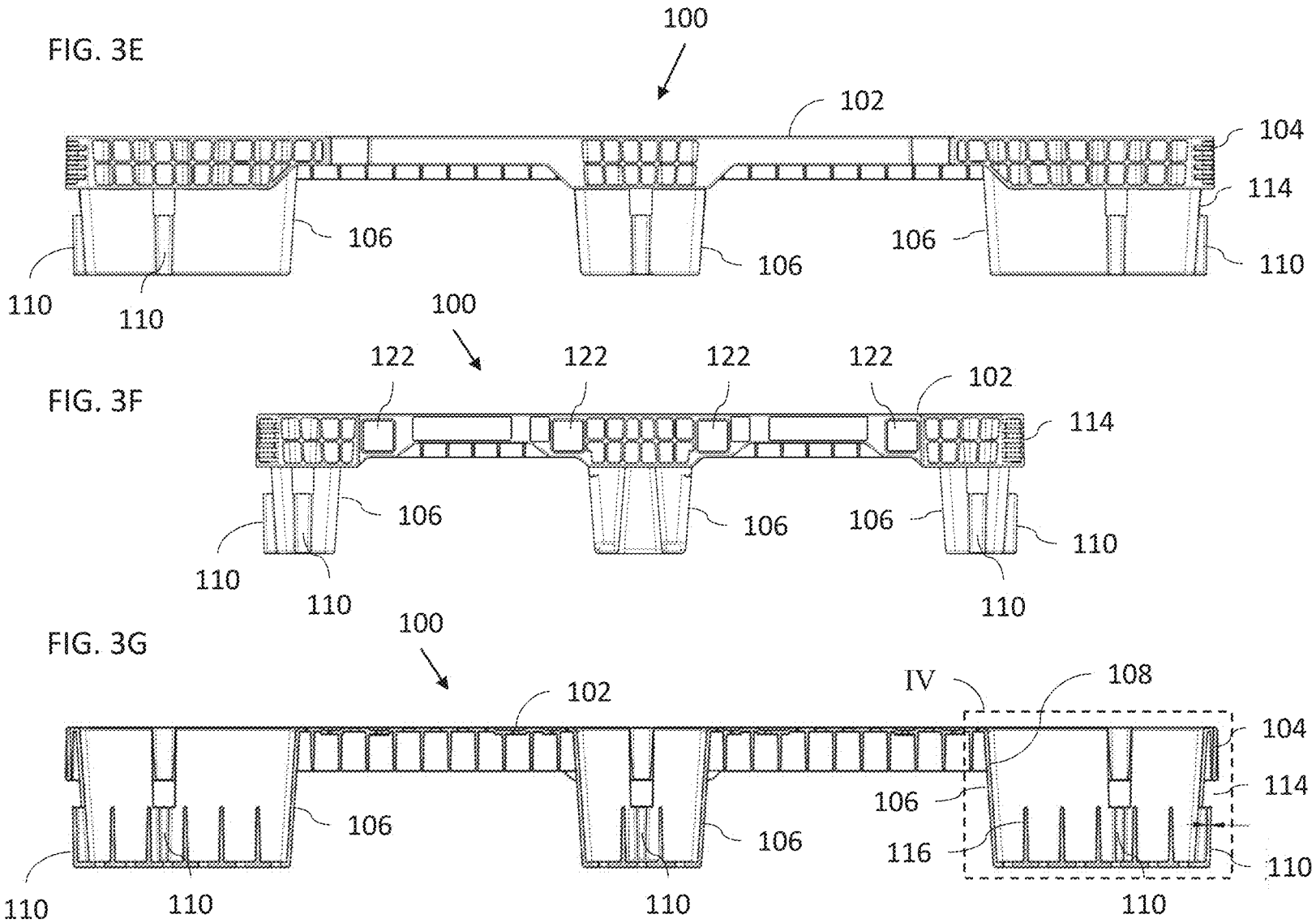
FIG. 3E is a side view of the pallet of FIG. 3A.
FIG. 3F is an end view of the pallet of FIG. 3A.
FIG. 3G is a cross-sectional view taken along the line III-III in FIG. 3D.
Figure 3H:
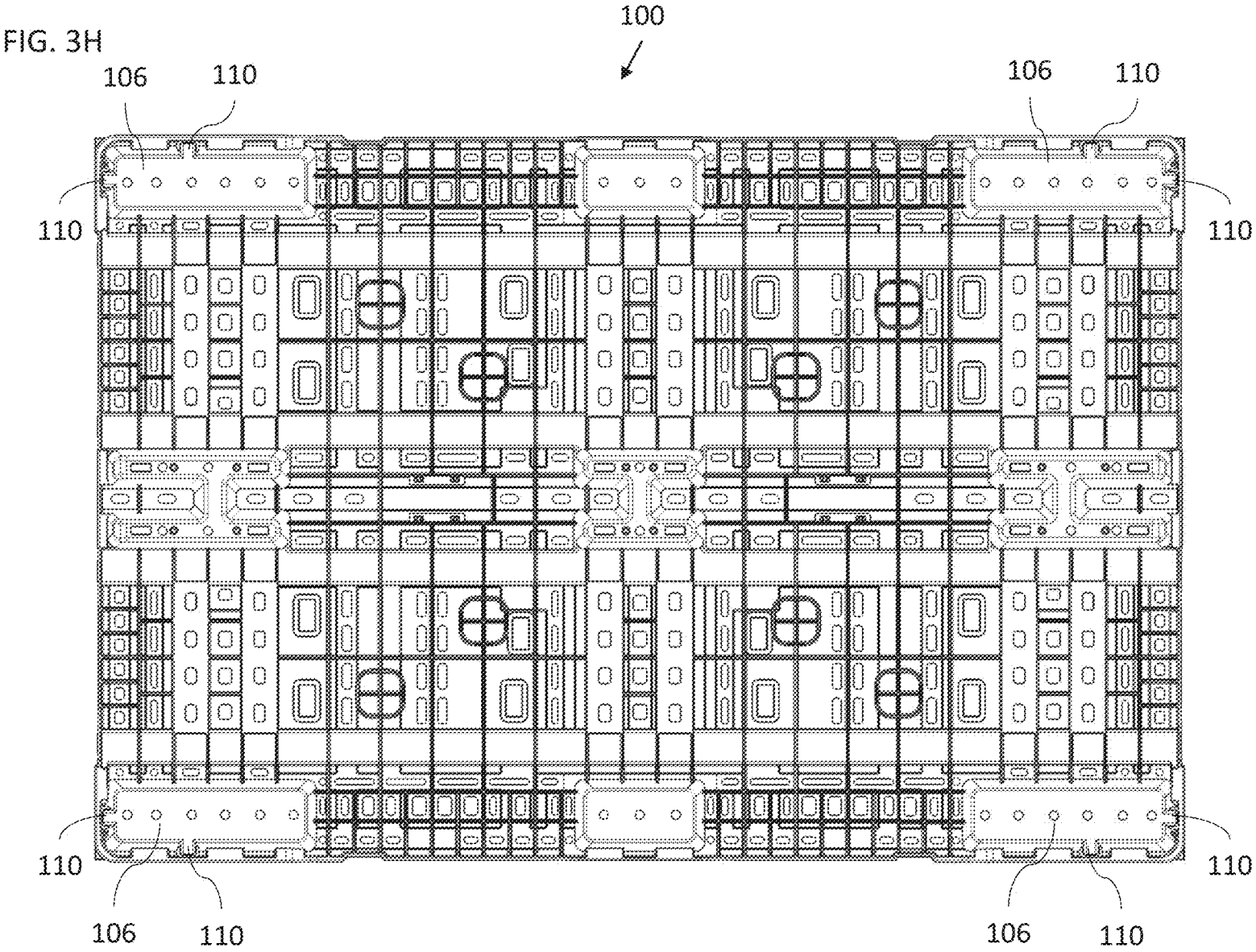
FIG. 3H is a bottom view of the pallet of FIG. 3A.
Figure 4B:
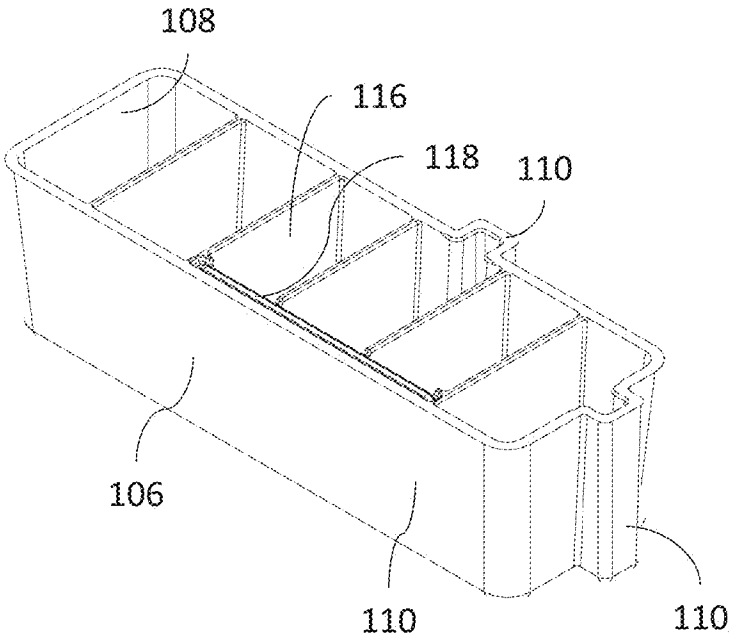
FIG. 4B is a cut-away isometric view of the leg of the pallet cut-away on a plane V-V in FIG. 4A.
Figure 4A:
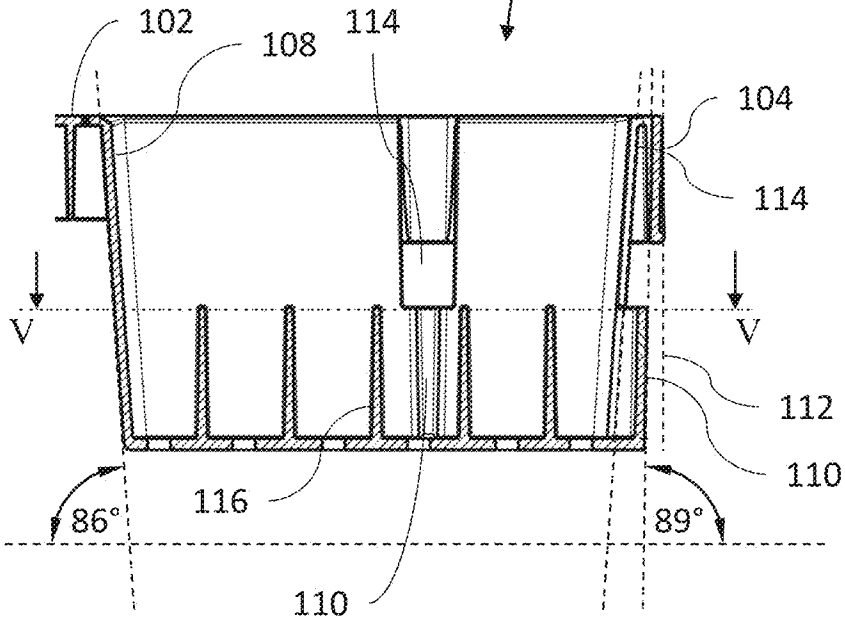
FIG. 4A is an enlarged view of a leg of the pallet shown in the region of FIG. 3G designated IV.
Figure 5A:
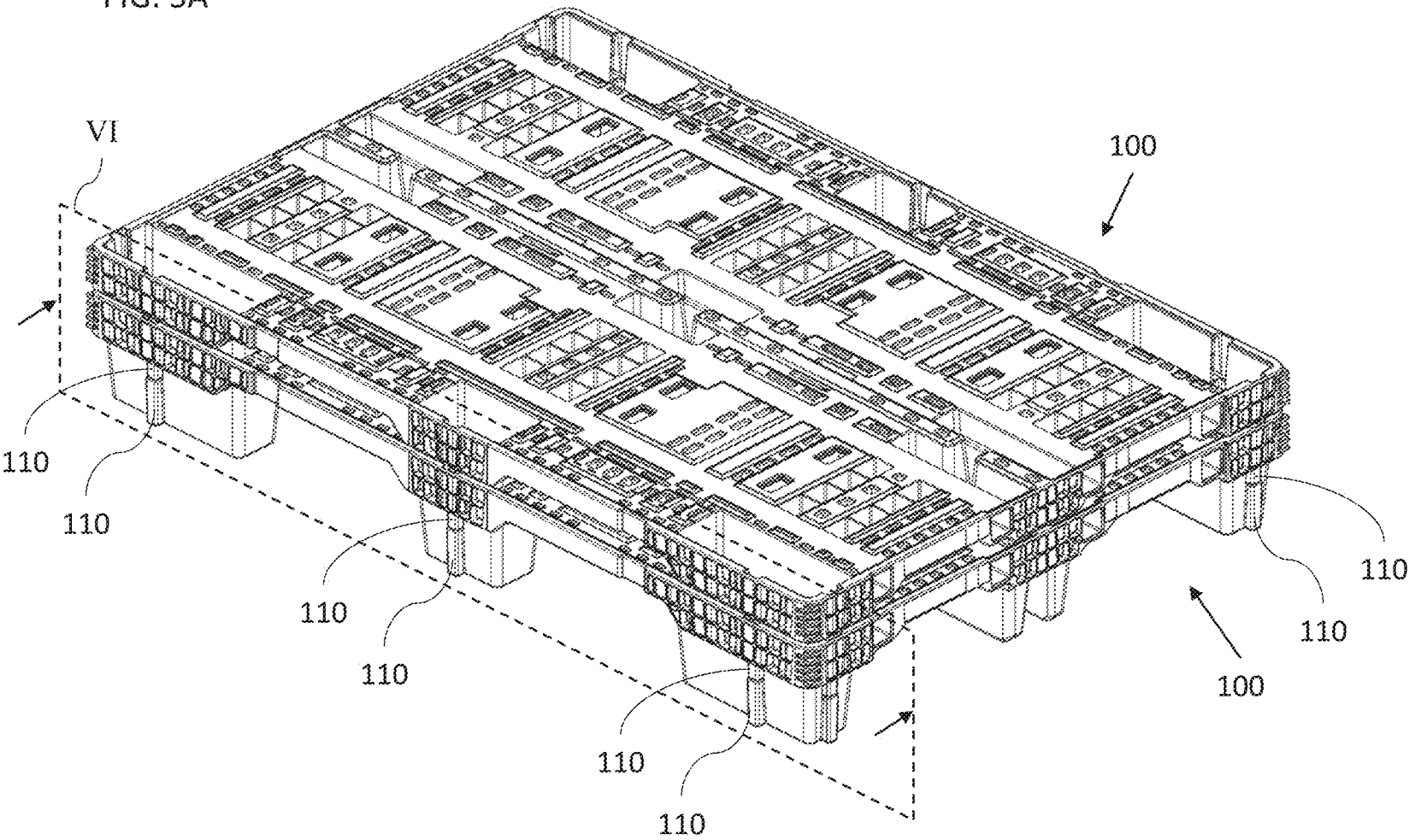
FIG. 5A is an isometric view showing two of the pallets of FIG. 3A nested together.
Figure 5B:
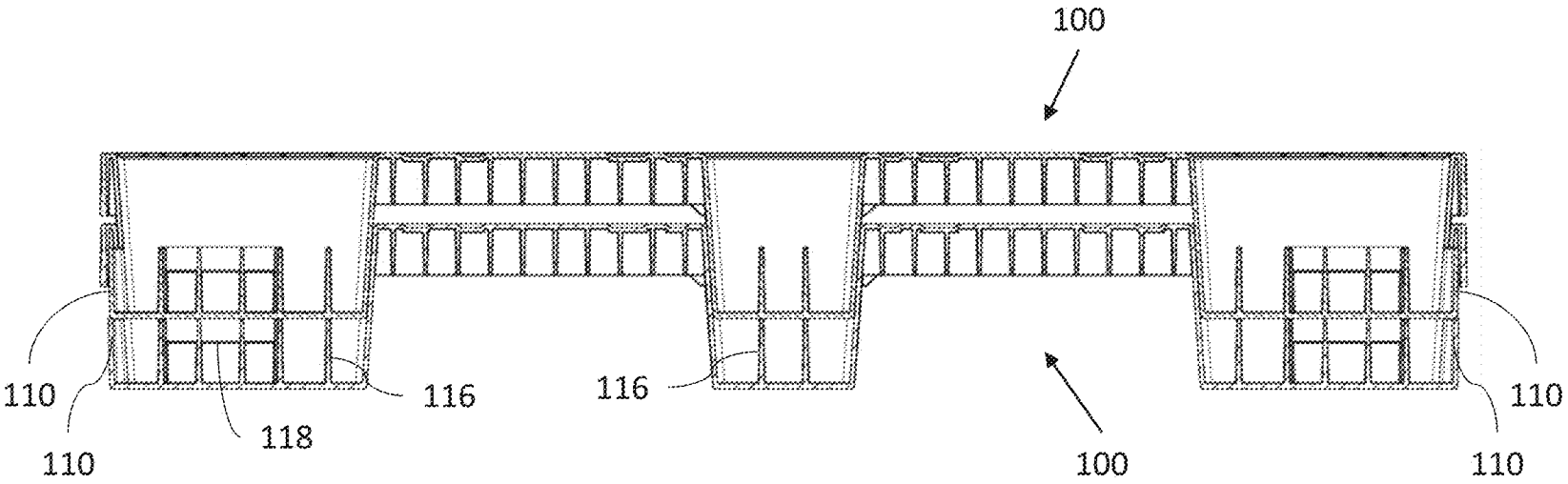
FIG. 5B is a cross-sectional view taken through the nested pallets of FIG. 5A on the plane designated VI.
Figure 6A:
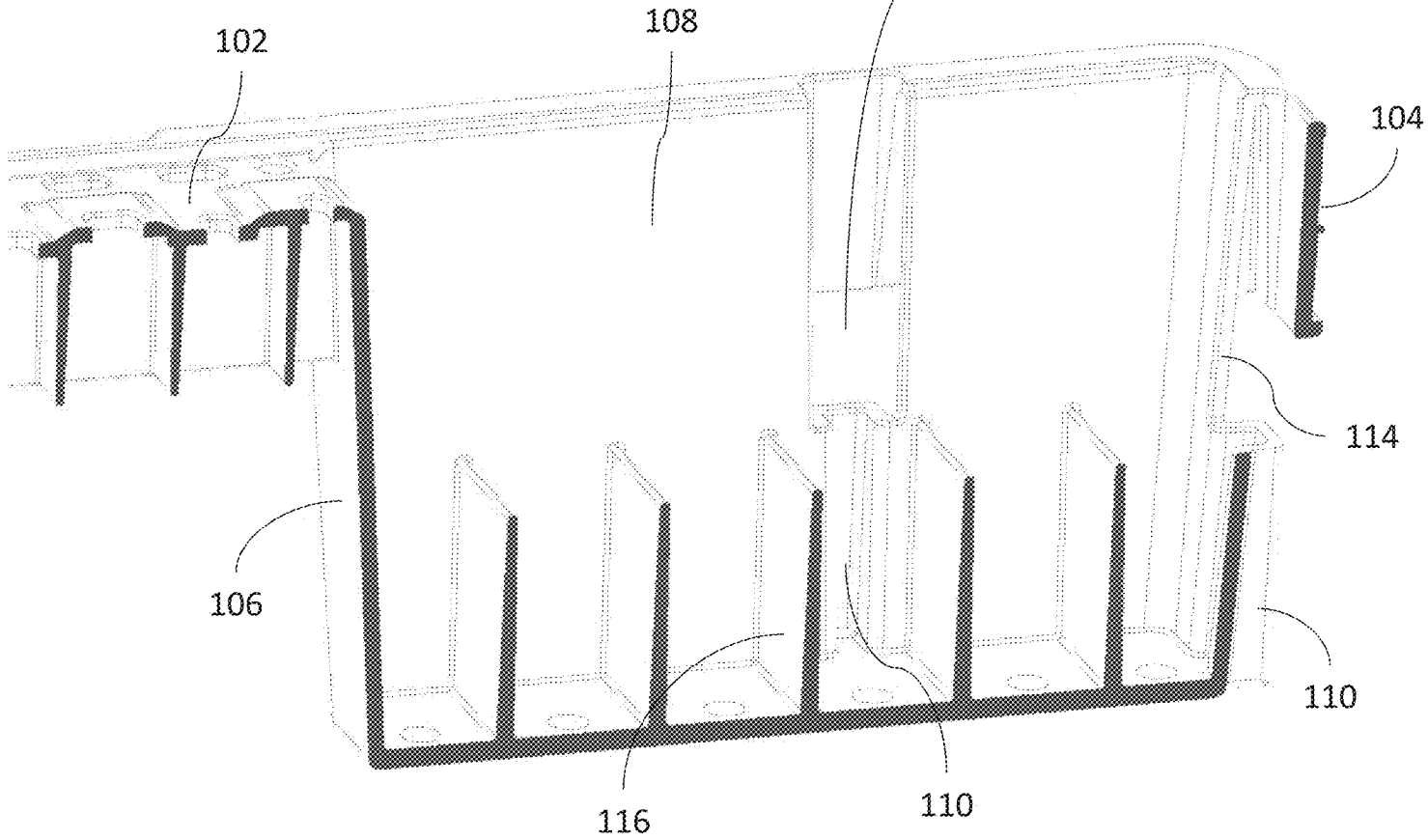
FIGS. 6A and 6B are cut-away isometric views of a corner leg of the pallet of FIG. 3A cut-away on vertical planes parallel to a length and a width of the pallet, respectively.
Figure 6B:
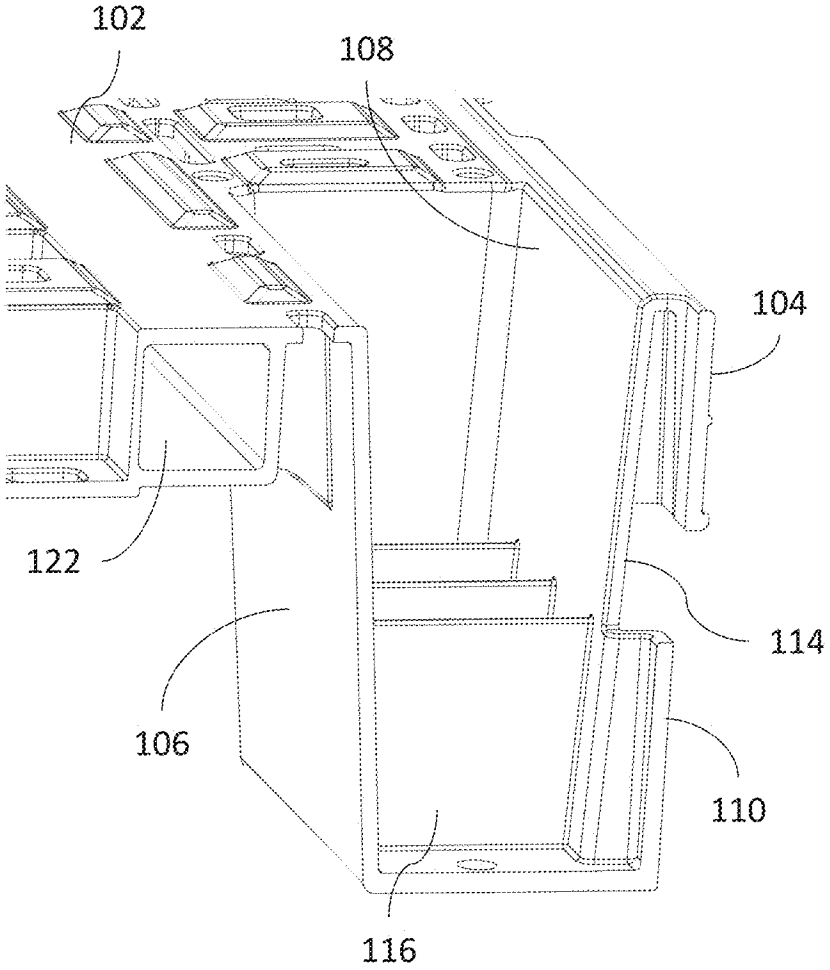
Figures 7A, 7B, 7C:
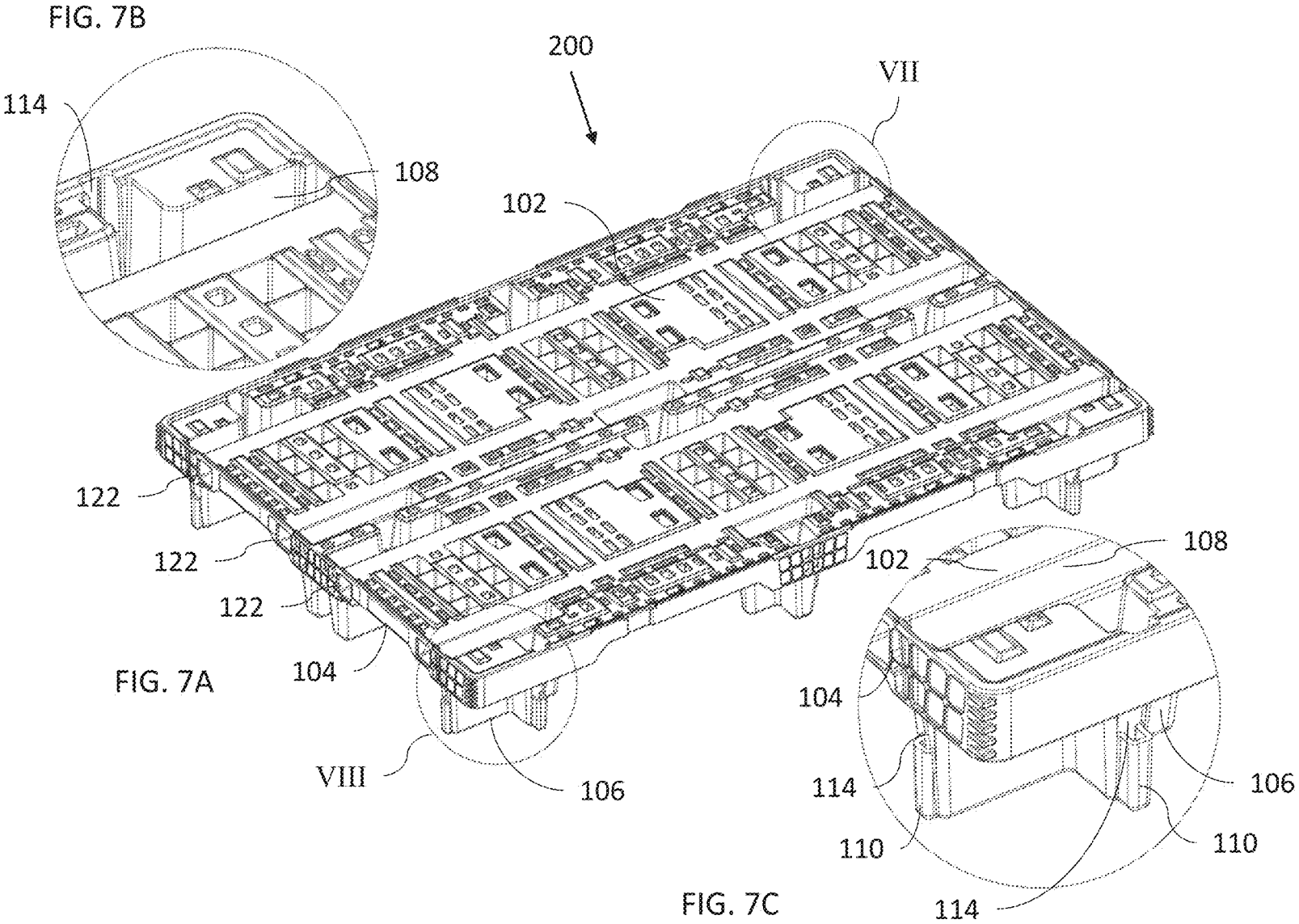
FIG. 7A is an isometric view of a pallet, constructed and operative according to the teachings of a further embodiment of the present invention.
FIGS. 7B and 7C are enlarged views of the regions of FIG. 7A designated VII and VIII, respectively.
Figure 8A:
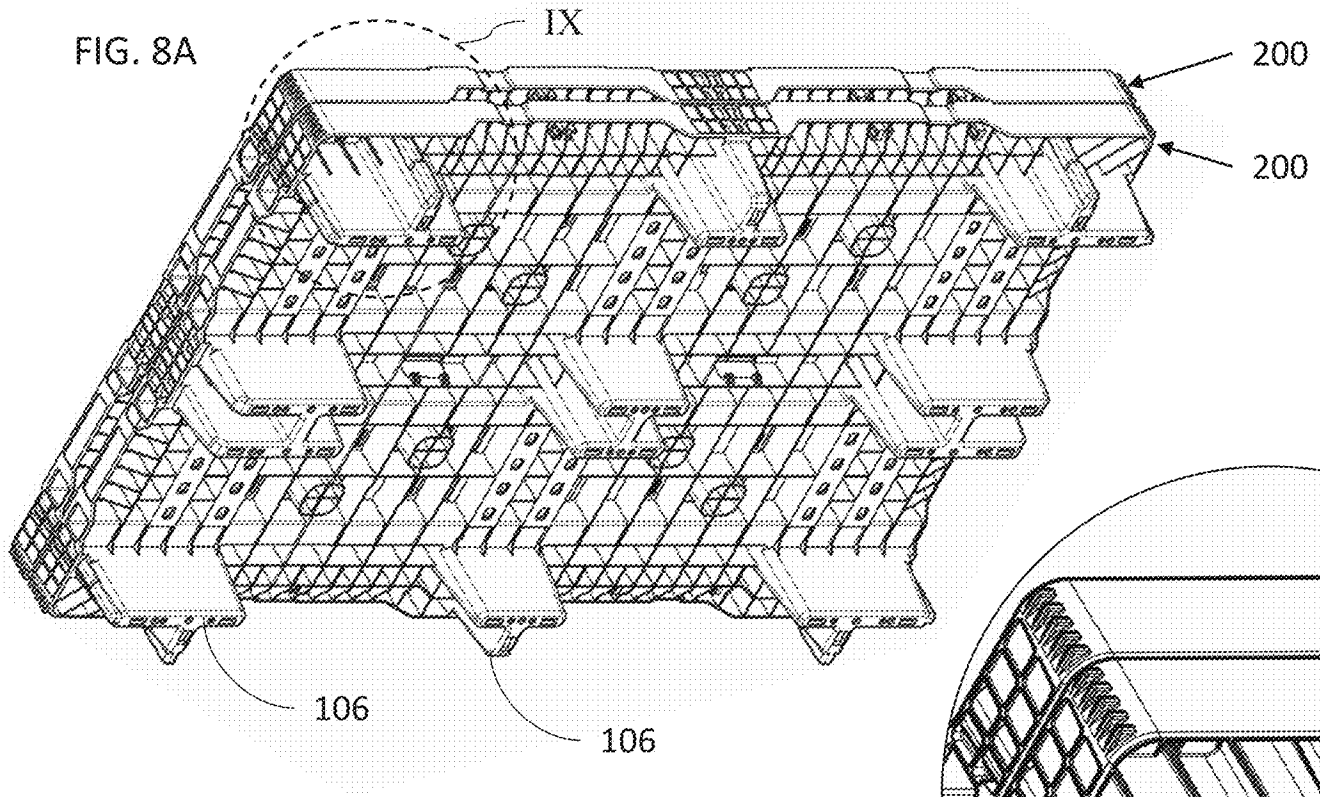
FIG. 8A is a lower isometric view showing two of the pallets of FIG. 7A nested together.
Figure 8B:
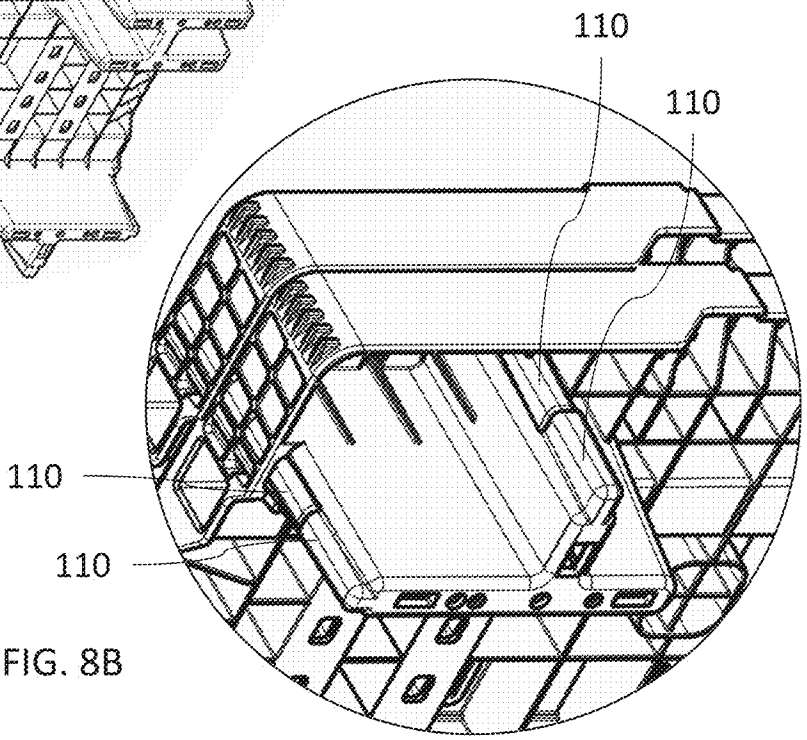
FIG. 8B is an enlarged view of the region of FIG. 8A designated IX.

The advantages of this leg structure may readily be understood. On one hand, the legs maintain the overall preferred geometry of nestable pallet legs, which requires a significant inward taper angle, preferably of at least 3 degrees, and typically about 4 degrees, providing compact nestability and strength. This taper angle is dictated by the geometry of nesting. For a pallet whose deck stands roughly 145 mm above the floor, and which nests to a depth of about 85 mm, i.e., with a vertical step between successive pallets of about 60 mm, clearance for nesting legs with a wall thickness of about 4 mm requires an angle of arctan (4/60), which approaches 4 degrees, making 4 degrees a good choice to ensure sufficient clearance and avoid wedging together of nested pallets. At the same time, by providing a lower-leg extension 110 projecting towards the edge 112 of the pallet, the extremity of the leg is brought much closer to the end of the pallet, thereby ameliorating the various shortcomings of conventional nestable pallets described above with reference to FIGS. 2B-2D. During nesting of empty pallets, lower-leg extension 110 is accommodated by the corresponding upper-leg opening 114 of an underlying pallet, and the lower-leg extension preferably stacks on top of the lower-leg extension of the underlying pallet when similar pallets are stacked, as illustrated in FIGS. 5A and 5B. As a result, the wall of the lower-leg extension may be vertical, or near vertical, subject to whatever draft angle is needed to ensure reliable release from a mold during manufacture. A draft angle of less than 2 degrees is preferred, and typically, roughly 1 degree is sufficient. Typical values of these angles are illustrated in FIG. 4A.

In a matter of terminology, where a taper, angle or inclination is referred to herein as "inward" or "converging," this refers to an inclination towards the center of the leg, so that the surface comes closer to the center as you move from the deck towards the base of the leg. Similarly, "outwards" refers to an inclination which diverges from the center of the leg as you go does from the deck towards the base of the leg. Thus, the main internal surfaces 108 of all of the pallet legs described herein (other than in the region of the lower-leg extensions) are referred to as inwardly tapered.

Legs 106 are described as being rigidly integrated with deck 102. In a first set of preferred implementations, the legs and the deck are integrally formed during a single injection molding manufacturing process. This option provides a maximum strength-to-weight ratio and reduced manufacturing costs, but limits options for repair of damaged pallets. In certain alternative preferred implementations (not shown), the leg structures may be manufactured separately and subsequently attached using any suitable form of attachment. Advantageously, a reversible form of attachment, such as an arrangement of threaded fasteners (screws or bolts), is used to attach the legs, thereby facilitating swapping out and replacement of any leg which becomes damaged.

In the preferred but non-limiting implementations of FIGS. 3A-9B, outer perimeter 104 of the deck is continuous (unbroken) around deck 102, thereby contributing optimally to the rigidity and strength of the pallet. Lower-leg extension 110 is therefore sized so as to fit within the outer perimeter when a plurality of similar pallets are stacked. The span between the oppositely projecting lower-leg extensions 110 at opposite ends of the pallet is therefore typically smaller than the outer dimension of the deck by at least about 6 mm (3 mm at each edge), to accommodate the wall thickness of the deck perimeter outside the upper-leg opening (which may optionally be locally thinned compared to the wall thickness used around the rest of the perimeter of the deck). The inset of the lower-leg extensions 110 relative to the edge 112 of the pallet is preferably between 6 mm and 20 mm, and most preferably in the range of 7-10 mm. By bringing the extremities of the legs within 2 cm of the edge of the pallet, and in some cases, within 1 cm of the edge, most of the limitations of conventional nestable pallets described above with reference to FIGS. 2B-2D are avoided, allowing the pallets to be used with functionality similar to non-nestable pallets.

In the implementation of pallet 100, the lower-leg extension is formed as an outwards undulation of the leg wall, thereby forming part of a closed shape of a lower part of the leg. This is best seen in the view of a leg 106 shown in FIG. 4B, cut-away on a horizontal plane. As seen here, the inwardly-tapered internal surface 108 of the hollow leg 106 defines a generally rectangular horizontal cross-sectional shape, and at least one edge of the rectangular horizontal cross-sectional shape is interrupted by the upper-leg opening and the lower-leg extension, where the lower-leg extension extends outside the rectangular horizontal cross-sectional shape. The "generally rectangular" shape is typically a rounded-corner rectangle, and the radius of the rounded corners may vary along the height of the leg as the horizontal dimensions and geometry change due to the taper angle. Much of the strength of the molded polymer legs is provided by these corner portions, so the lower-leg extensions and upper-leg openings are preferably implemented as modifications of the flat regions of the leg walls while leaving the corner regions complete along the entire height of the leg. A set of reinforcing ribs 116 are typically provided in the lower part of the hollow leg, as is common in the art, providing added rigidity and providing surfaces against which the foot of a similar pallet sit when nested, as best seen in FIG. 5B, thereby preventing over-insertion and wedging together of the pallets. Also visible in FIG. 4B is a slot 118 which may optionally be provided for insertion of an RFID, to support various pallet tracking functions.

The choice of positioning for the peripheral support configurations depends on the expected applications. For example, for racking, provision of the peripheral support configurations on the legs at either extremity of the short sides of the pallet may be sufficient. However, for maximum flexibility of application, it is typically preferable to provide the peripheral support configurations along all four sides of the pallet. To this end, the hollow legs adjacent to the corners of the deck are most preferably provided with two of the peripheral support configurations extending towards two adjacent edges of the pallet, as seen, for example, in FIGS. 3B and 3C. In certain applications, for example, in the context of pallet conveyor systems where a central pallet-stop is used to align the pallet before a change in direction, it may be preferred to provide a peripheral support configuration also on a middle leg adjacent to the long sides of the pallet, thereby ensuring consistent alignment of the pallet by the pallet-stop.

Turning now to FIGS. 7A-8B, there is shown a nestable pallet, generally designated 200, constructed and operative according to a further embodiment of the present invention. Pallet 200 is generally similar to pallet 100 described above, with equivalent features labeled similarly. Pallet 200 differs primarily from pallet 100 in that, instead of the generally rectangular legs 116 of pallet 100, the legs 216 of pallet 200 are implemented with reduced-size openings, to provide greater continuity (smaller openings) at the upper surface of deck 102. By way of non-limiting example, the legs are shown here implemented with cross-sectional shapes similar to those disclosed in U.S. Pat. No. 11,820,551, where each leg has a horizontal cross-sectional shape made up of the intersection of a number of relatively long and thin shapes, forming generally T-shaped or H-shaped legs. These shapes are modified by addition of the above-described peripheral support configurations, including lower-leg extensions 110 and upper-leg openings 114. In all other respects, pallet 200 is structurally and functionally similar to pallet 100, and will be clearly understood by analogy to the structures and functions described and illustrated above.

Figure 9A:
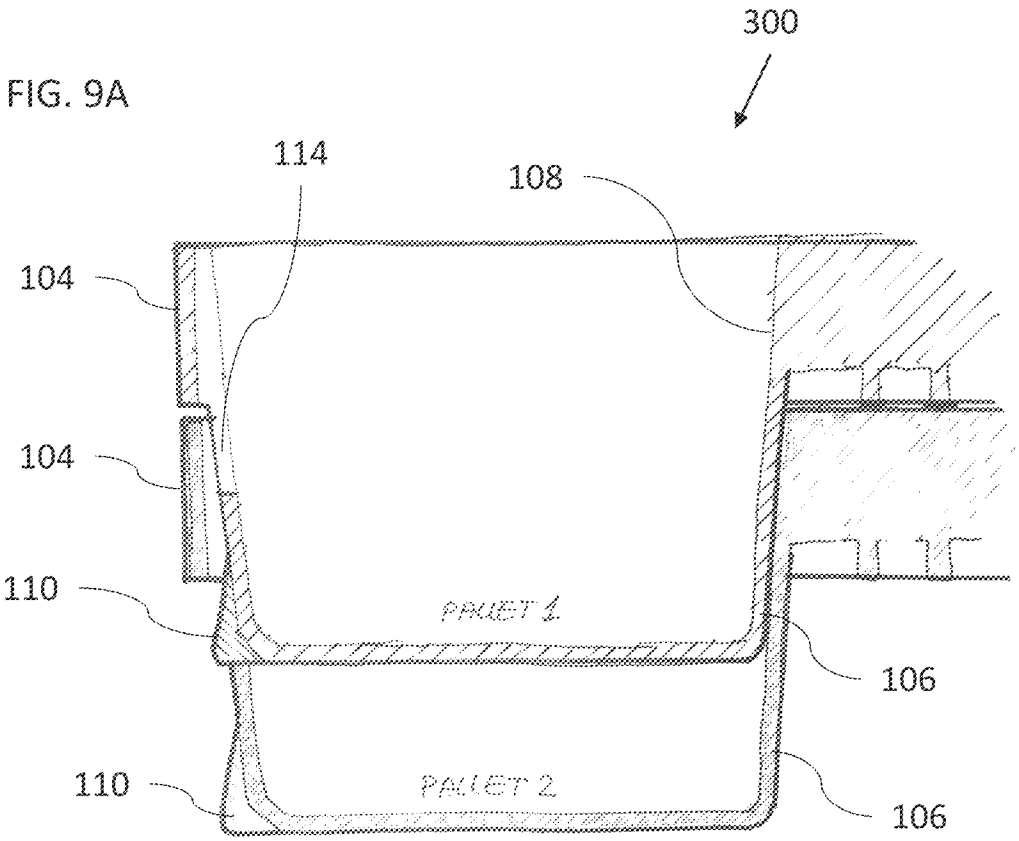
FIG. 9A is a schematic vertical cross-sectional partial view taken through the legs of two nested pallets according to a further variant implementation of a pallet according to an embodiment of the present invention, where a lower-leg extension diverges outwards from a generally inwardly-tapered profile of the legs.
Figure 9C:
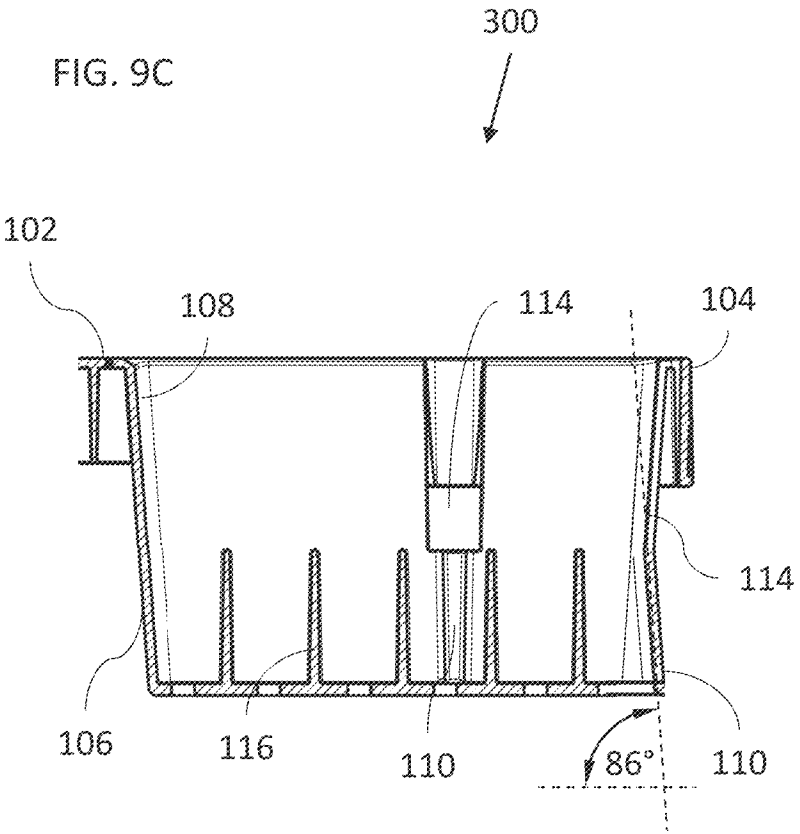
FIG. 9C is a schematic vertical cross-sectional partial view of a leg of a pallet illustrating a second alternative implementation of the diverging lower-leg extension of FIG. 9A.
Figure 9B:
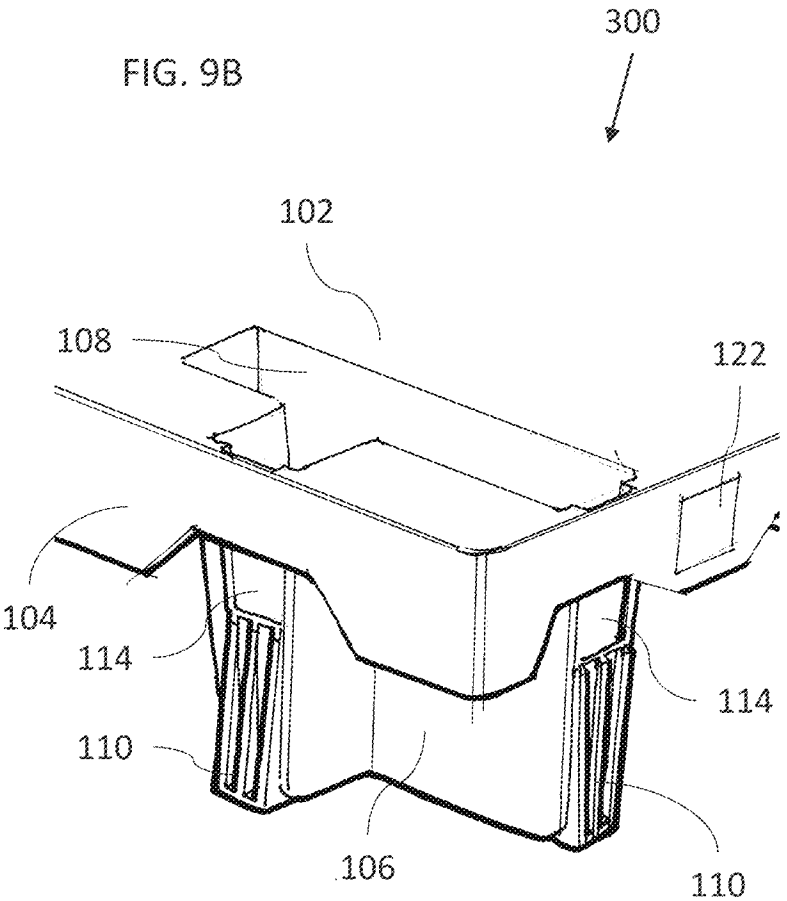
FIG. 9B is a partial isometric view of a leg of a pallet illustrating a first alternative implementation of the diverging lower-leg extension of FIG. 9A.

Turning now to FIGS. 9A-9C, while the above embodiments illustrate the lower-leg extensions 110 as being vertical or with a slight inward draft angle, alternative implementations of a pallet 300 may provide a lower-leg extension 110 which is angled outwards towards the base of the leg, thereby ensuring that the closest point of contact with an underlying surface is at the closest point of the leg to the end of the pallet. This is illustrated schematically in FIG. 9A, which shows the lower-leg extension as being a thickened portion of the wall of the leg. This thickened portion may be provided, for example, by attachment of an extension element, such as by adhesive, heat welding or by any other suitable form of mechanical attachment. Alternatively, the lower-leg extension may be formed by use of a suitable mold as part of the primary injection-molding process of manufacture of the pallet. FIG. 9B illustrates one possible implementation for injection molding, requiring a lateral moving core to form the external rib structure to support the extension. FIG. 9C illustrates an alternative approach in which a mold is designed to form an outwardly-inclined wall portion of normal wall thickness to provide the lower-leg extension 110. This can be achieved by employing a lower mold portion which, in the region of the lower-leg extension, extends upwards into the internal volume of the leg, and a complementary upper mold portion which extends downwards through the upper-leg opening 114 to define the outer surface of the lower-leg extension. The various design considerations for designing molds to manufacture the implementations of FIGS. 9B and 9C will be clear to a person having ordinary skill in the art.

Figure 10:
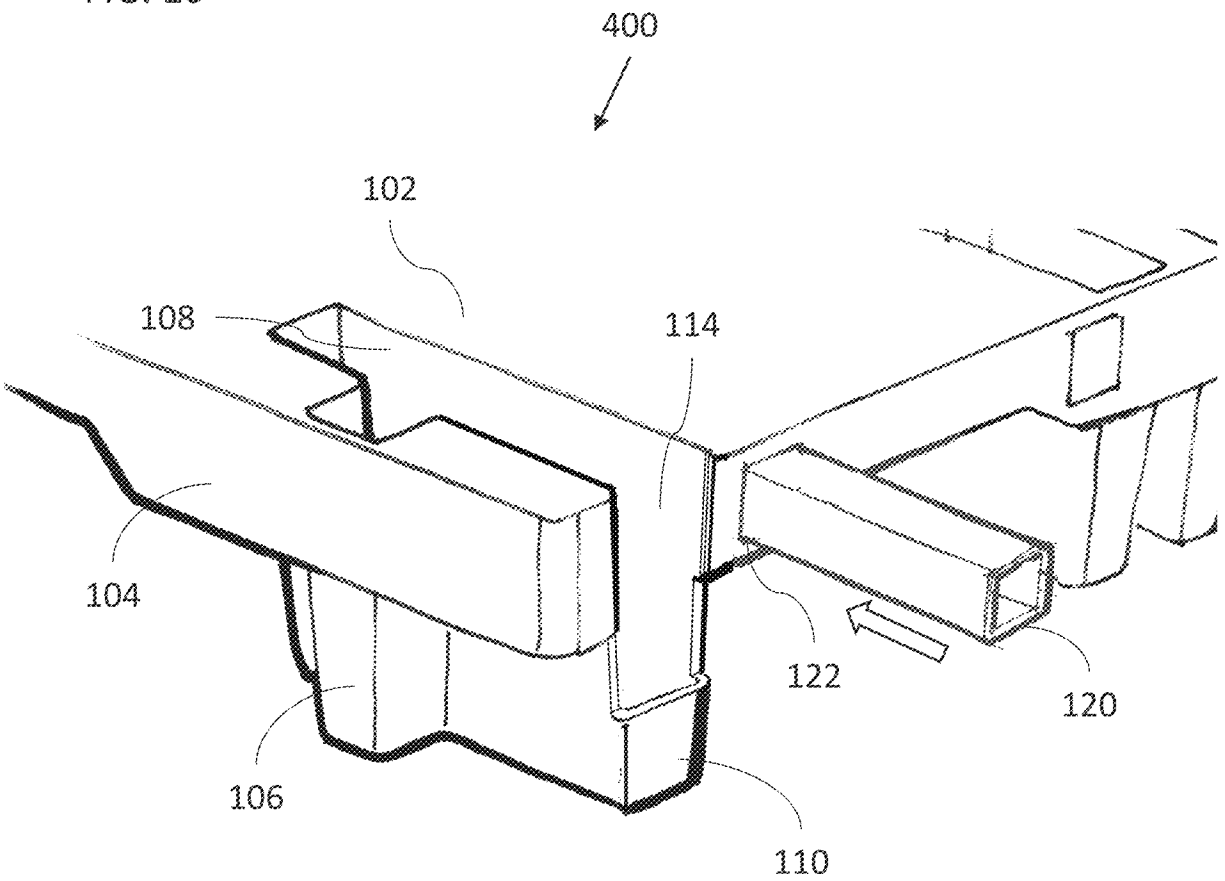
FIG. 10 is a schematic partial isometric view of a leg of a pallet according to a further alternative embodiment of the present invention.

Turning now to FIG. 10, while the above-described implementations all maintain a continuous outer perimeter 104 around deck 102, certain alternative implementations of a pallet 400 employ an upper-leg opening 114 that extends to the perimeter of the pallet, forming a gap in perimeter 104. Although this may reduce the overall rigidity of the pallet, it allows the lower-leg extension to extend to the end of the pallet, thereby emulating more closely the functionality of non-nesting pallets. Pallet rigidity can be maintained by use of reinforcing beams 120 (shown here during insertion), typically formed of metal or of reinforced polymer materials, inserted along corresponding channels 122 along the length of pallet 400. Parenthetically, such reinforcing beams and channels are advantageously also used in the previously-described embodiments, as illustrated by way of non-limiting examples in FIGS. 3A, 3F, 6B, 7A and 9B.

As seen in FIG. 10, the part of the leg 106 below the region of vertical overlap during nesting of the pallets is preferably formed with a closed shape (in a horizontal plane), thereby maintaining much of the strength and rigidity of the leg structure.

Figure 12A:
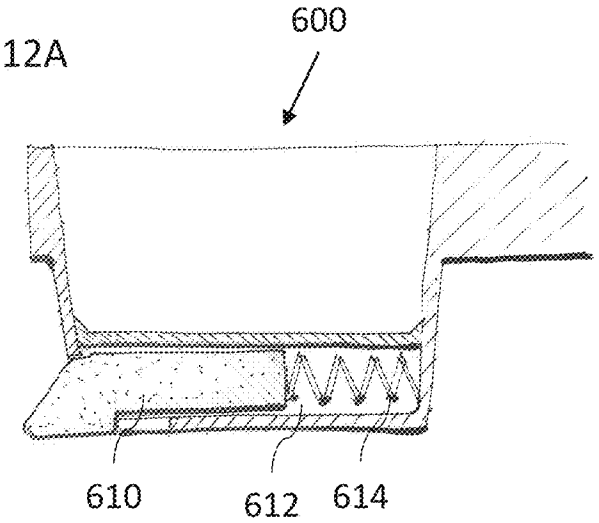
FIGS. 12A and 12B are schematic vertical cross-sectional partial views taken through a leg of a pallet according to a further embodiment of the present invention, showing a slidably-retractable lower-leg extension in a deployed and retracted state, respectively.
Figure 12B:
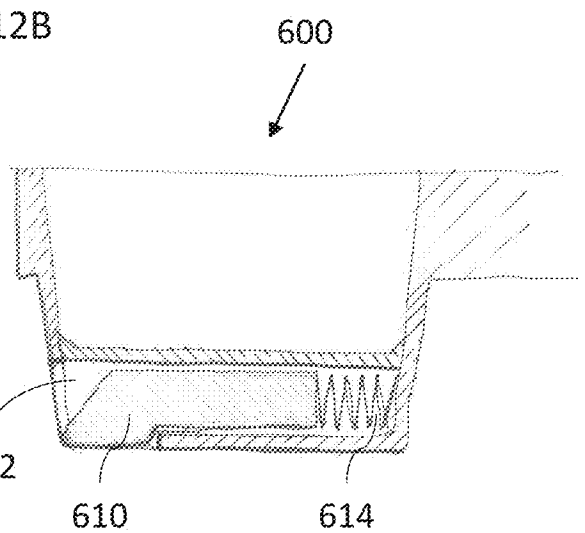
Figure 11A:
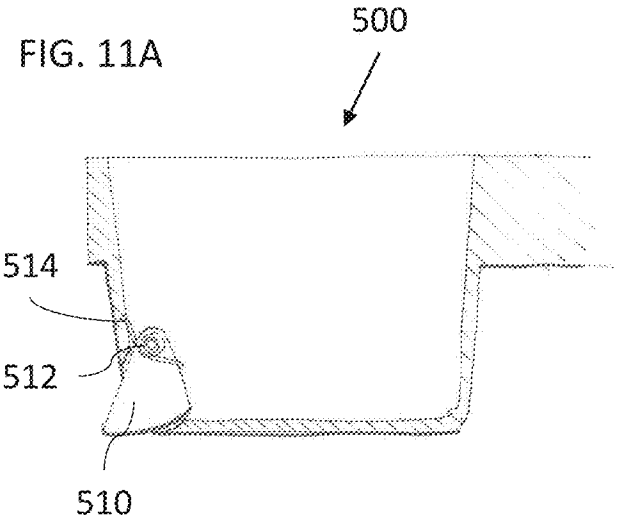
FIGS. 11A and 11B are schematic vertical cross-sectional partial views taken through a leg of a pallet according to a further embodiment of the present invention, showing a pivotably-retractable lower-leg extension in a deployed and retracted state, respectively.
Figure 11B:
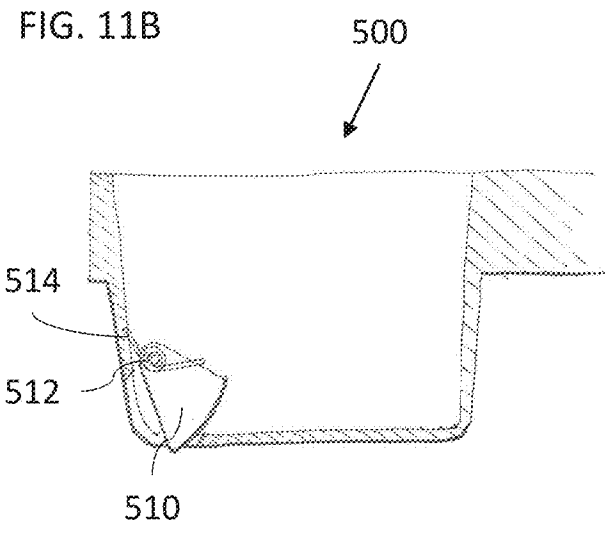

Referring finally to FIGS. 11A-12B, as an alternative to the rigid lower-leg extensions of the above embodiments, pallets 500 and 600 according to the teachings of certain embodiments of the present invention employ a displaceable lower-leg extension 510 or 610 to provide an extension to some of the pallet legs while in use (FIGS. 11A and 12A), and which retracts for nesting of the pallets (FIGS. 11B and 12B). In these cases, the upper-leg opening of the previous embodiments is not required, since the leg extensions retract to allow nesting. Where the leg extension is accommodated within an inner volume of the leg when retracted, a lower-leg opening is required to allow outward projection of the leg extension when deployed.

In the case of pallet 500, lower-leg extension 510 is pivotally mounted on a pivot axis 512, and is spring-biased by spring 514 towards its deployed state of FIG. 11A. Lower-leg extension 510 may be manually retractable for nesting, for example, being retained in its retracted state by a catch mechanism (not shown) which releases on nesting with an underlying pallet so as to automatically deploy on separation of the pallets. Alternatively, the shape of the extension and the corresponding surfaces of the leg may be such that the lower-leg extension is mechanically displaced by interaction of two pallets during nesting so that it retracts without manual intervention.

In the case of pallet 600, lower-leg extension 610 is slidingly displaceable along a channel 612, defined in the pallet leg, under the bias of a spring 614. As in pallet 500, the same options of manual retraction, with or without a catch mechanism, or of retraction due to mechanical interaction between the pallets during nesting, are all possible implementations.

It will be appreciated that the above descriptions are intended only to serve as examples, and that many other embodiments are possible within the scope of the present invention as defined in the appended claims.

What is claimed is:

1. A nestable pallet for supporting a load above a floor comprising:

(a) a deck having an upper surface for supporting the load, said deck having an outer perimeter; and (b) a set of hollow legs integrally formed with said deck so as to be rigidly integrated therewith and extending downwards from said deck so as to support said deck above the floor, each of said hollow legs having an upper opening and an inwardly-tapered internal surface for receiving part of a corresponding leg of another pallet when a plurality of similar pallets are stacked, wherein a plurality of said hollow legs adjacent to said outer perimeter each includes a peripheral support configuration comprising:

(i) a lower-leg extension projecting horizontally from an inwardly-tapered portion of said leg towards an edge of the pallet corresponding to a downwards projection of said outer perimeter, and (ii) an upper-leg lateral opening for receiving the lower-leg extension of another pallet when a plurality of similar pallets are stacked, and wherein at least one of said hollow legs adjacent to a corner of said deck is formed with two of said peripheral support configurations with rigid lower-leg extensions extending towards two adjacent edges of the pallet.

2. The nestable pallet of claim 1, wherein said lower-leg extension forms part of a closed shape of a lower part of said leg.

3. The nestable pallet of claim 1, wherein said inwardly-tapered portion of said leg has a taper angle of at least 3 degrees, and wherein said lower-leg extension has a draft angle of no more than 2 degrees.

4. The nestable pallet of claim 1, wherein said outer perimeter of said deck is continuous around said deck, and wherein said lower-leg extension is sized so as to fit within said outer perimeter when a plurality of similar pallets are stacked.

5. The nestable pallet of claim 1, wherein said inwardly-tapered internal surface of each of said hollow legs defines a generally rectangular horizontal cross-sectional shape, and wherein at least one edge of said rectangular horizontal cross-sectional shape is interrupted by said upper-leg opening and said lower-leg extension, said lower-leg extension extending outside said rectangular horizontal cross-sectional shape.

6. A nestable pallet for supporting a load above a floor comprising:

(a) a deck having an upper surface for supporting the load, said deck having an outer perimeter; and (b) a set of hollow legs rigidly integrated with said deck and extending downwards from said deck so as to support said deck above the floor, each of said hollow legs having an upper opening and an inwardly-tapered internal surface for receiving part of a corresponding leg of another pallet when a plurality of similar pallets are stacked, wherein a plurality of said hollow legs adjacent to said outer perimeter each includes a peripheral support configuration comprising:

(i) a lower-leg extension projecting horizontally from an inwardly-tapered portion of said leg towards an edge of the pallet corresponding to a downwards projection of said outer perimeter, and (ii) an upper-leg opening for receiving the lower-leg extension of another pallet when a plurality of similar pallets are stacked, wherein said inwardly-tapered internal surface of each of said hollow legs defines a generally rectangular horizontal cross-sectional shape, and wherein at least one edge of said rectangular horizontal cross-sectional shape is interrupted by said upper-leg opening and said lower-leg extension, said lower-leg extension extending outside said rectangular horizontal cross-sectional shape.

* * * * *